United States Patent [19]

Rootham et al.

[11] 4,379,081

[45] Apr. 5, 1983

[54] METHOD OF ENCAPSULATING WASTE RADIOACTIVE MATERIAL

[75] Inventors: Michael W. Rootham, Monroeville, Pa.; James A. Forrester, Buckinghamshire, United Kingdom

[73] Assignee: Westinghouse Electric Corp., Pittsburgh, Pa.

[21] Appl. No.: 243,103

[22] Filed: Mar. 12, 1981

[51] Int. Cl.[3] ..... G21F 9/16

[52] U.S. Cl. ..... 252/628; 106/97; 106/98

[58] Field of Search ..... 252/628; 106/97, 98

[56] References Cited

U.S. PATENT DOCUMENTS

| | | | |
|---|---|---|---|
| 3,429,726 | 2/1969 | Takabayashi | 106/97 |
| 4,135,940 | 1/1979 | Peltier | 106/98 |
| 4,204,876 | 5/1980 | Bowden | 106/97 |

*Primary Examiner*—Benjamin R. Padgett
*Assistant Examiner*—Joel P. Okamoto
*Attorney, Agent, or Firm*—Z. L. Dermer

[57] ABSTRACT

A method of encapsulating radioactive waste including withdrawing radioactive liquid having a retardant therein from a source. The retardant may including borates, or other additives, which retard the setting of cements by preventing hydration at cement particles in the mix. The liquid is mixed with ordinary Portland cement and subjected to long term shear far in excess of that needed to form ordinary grout. The use of shear to overcome set retardation, and similarly, the deliberate regulation of acceleration of set in hydraulic cement pastes by the utilization of retardants plus shear produces a thixotropic paste with extreme moldability which will not bleed, and finally sets more rapidly than can be expected with normal mixing to form a very strong product.

10 Claims, 7 Drawing Figures

METHOD OF ENCAPSULATING WASTE RADIOACTIVE MATERIAL

BACKGROUND OF THE INVENTION

The invention described herein relates to the disposal of radioactive waste and more particularly to a method of making hydraulic cement thixopastes which encapsulate the radioactive material.

The heat exchange coolant circulated through the primary and secondary loops of a nuclear reactor during the course of its operation, accumulates and carries radioactive matter which must be removed from the coolant system. This matter which constitutes harmful waste products consists of both dissolved and solid particulate material, such as that resulting from ion exchange scrubbing of waste waters, leaking fuel rods, corrosion of metallic parts, sludges from filters and evaporators, and the like, together with other dissolved impurities, all of which have been irradiated and take on radioactive characteristics.

In the past, removal of these radioactive byproducts (radwaste) from the coolant system has been effected by mechanical filters of different types, chemical precipitating agents, evaporators and demineralizers, and other means capable of capturing and retaining particles often microscopic in size. The capturing agents or mediums together with the radioactive materials which often contain boron were mixed with other more concentrated liquids or solids, such as glass, or disposed of by encapsulating the resultant product in cement or cement lined steel tanks suitably designed for long-term disposal. It has been considered that an ideal method of encapsulating these materials together with other radioactive wastes from laboratories, field operations, and the like, was to mix them with cement and store the cement-waste product in oil drums of 55 gallon capacity. However, attempts to encapsulate the borated waste coolant from light water reactors in hydraulic cements have presented problems associated with variable retardation of set in in the cement mixture, segregation of material within the encapsulation container and the formation or release of free liquid in the form of bleed water.

The borates present in the waste coolant retard the setting of cements by forming calcium borates on the hydrating surface of the cement particles, thereby blocking calcium silicate hydration and the double salt formation reaction between sulphate and aluminates. As a result of the unwanted precipitation reaction, there is a delay in the setting time and a retardation in the rate of strength development, together with the segregation of liquid from the paste as sedimentation takes place under the influence of gravity. Evidence of the delay in setting time can be seen in the heat evolution rate curves of FIG. 1 wherein the hydration pattern of cement paste made with water is compared with the pattern from the same paste made with saturated borax solution.

SUMMARY OF THE INVENTION

Briefly stated, the above disadvantages of the prior art are overcome by this invention by providing a method of making hydraulic cement thixopastes which overcome the set retardant effects of borates upon hydraulic cements, so that non-recyclable reactor coolant wastes can be encapsulated in a hard, non-bleeding block of cement. The method includes the shearing of cement at a very high rate to eliminate the adverse effects of borates and thus effect complete bonding of the cementious material. This is accomplished by the application of extensive long term shear to a paste consisting of hydraulic cement plus a retarding agent with or without the presence of bulk additives. The end product is a thixotropic paste with extreme moldability which does not bleed and finally sets more rapidly than cements of normal mix, to form a very strong product. The method includes the deliberate regulation of acceleration of set in hydraulic cement pastes by utilizing retarding agents, such as calcium borate, in combination with extended shear mixing of the cement to thus develop the necessary properties in the cement/liquid mix.

BRIEF DESCRIPTION OF THE DRAWINGS

While the foregoing discussion identifies problems presently existing in the prior art together with a general description of how they may be overcome, it is believed the following disclosure of the preferred embodiment of the invention will be better understood by reference to the accompanying drawings wherein.

DESCRIPTION OF THE PREFERRED EMBODIMENT

Figure 1:
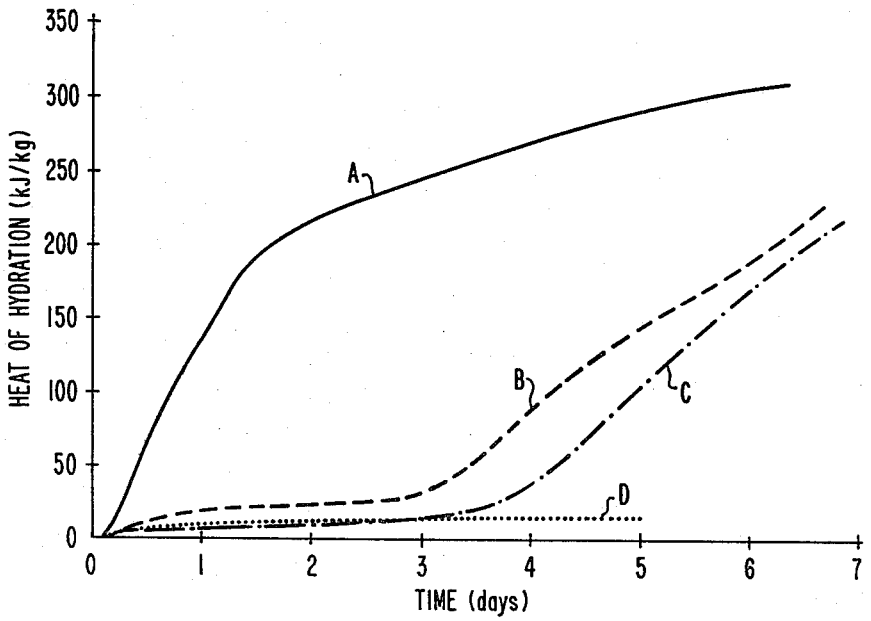
FIG. 1 illustrates heat evolution rate curves which shows the hydration patterns of cement paste made with water and paste made with other liquid bases.

Referring to FIG. 1, the heat evolution rate curves show heat of hydration versus time for ordinary Portland cement paste made with water (curve A) and with a saturated borax solution (curve B) and for the condition where borates are precipitated out of the mix before hydration with excess calcium hydroxide (curve C) or calcium chloride (curve D), all at 20° C. and with a water/cement ratio of 0.5. The adverse effects that borates have on the internally generated heat of reaction in the mix and consequent setting time is clearly evident from the curves in this figure. Retardants are used in the construction industry to retard setting of cements and these are classified by the Cement Association as Class III and Class IV retardants. They may be used in the invention described herein, although the invention is more specifically directed toward the action which borates have on the setting of cement when used for encapsulation purposes. The waste from reactor systems intended to be solidified normally contain boric acid but the curves in FIG. 1 are based on liquid wastes containing sodium borate (borax) which is a base rather than an acid solution. The addition of sodium hydroxide to borated wastes upstream of the waste evapoator neutralizes the boric acid and thus minimizes evaporator material problems. The waste solutions to be encapsulated therefore ultimately have basic rather than acidic characteristics. Waste solutions having high levels of boric acid can be encapsulated according to the teachings of this invention, but it is preferable to neutralize the solution to obtain consistent and uniform encapsulations of waste products. For demonstration purposes a cement mixture has been defined as being one which falls within the following range to form a thixopaste:

Water/Cement: 0.45±0.05 w/w
Borate: 0–21000 ppm as Boron
Bulk Additive/Liquid: 0–1.65 v/v A cement mixture containing a water/cement ratio of 0.55 will form a thixopaste provided that the period of shearing, or the number of shears is increased beyond that for cements in the water/cement range around 0.45 as more fully described hereafter. In the above ranges, 2500 ppm boron corresponds to 2.2% borax while 21000 ppm boron is the equivalent of 18.5% borax.

The preferred cement to be used for encapsulation is ordinary Portland cement because worldwide its properties and composition are within a small well defined range. Calcium sulfate hemihydrate could be used in lieu of Portland cement and although the retardation by borax is less with the plaster than with cement, this material did not give the colloidal suspending media found with Portland cement. Also, Rapid Hardening Portland cement may seem attractive but colloidal mixing has the ability to induce the properties of Rapid Hardening Portland cement into an ordinary Portland cement.

To achieve mixing of the cement mixture, different types of mixing equipment may be used but the preferred types are any one of the various "colloidal" mixers or mills which are commercially available in the industry. The colloid producing method is the one usually regarded as most suitable for producing cement grouts used in building construction, with or without sand, and is the type utilized in this invention. The application of shear to ordinary cement/water pastes separates the colloidal hydrates formed on the surface of the cement to produce a stable sol. Similarly, precipitates formed on the cement surface in a wet paste can be removed by the application of shear to the paste, hence new areas of surface are made available for hydration and the subsequent reactions of the cement/water system. Shear mixing has been successfully applied to cements commercially used for grouting. The normal mixing times for commercial grouts range between 15 and 60 seconds. This action keeps the cement particles in suspension, and, intuitively, must improve water retention.

Figure 2:
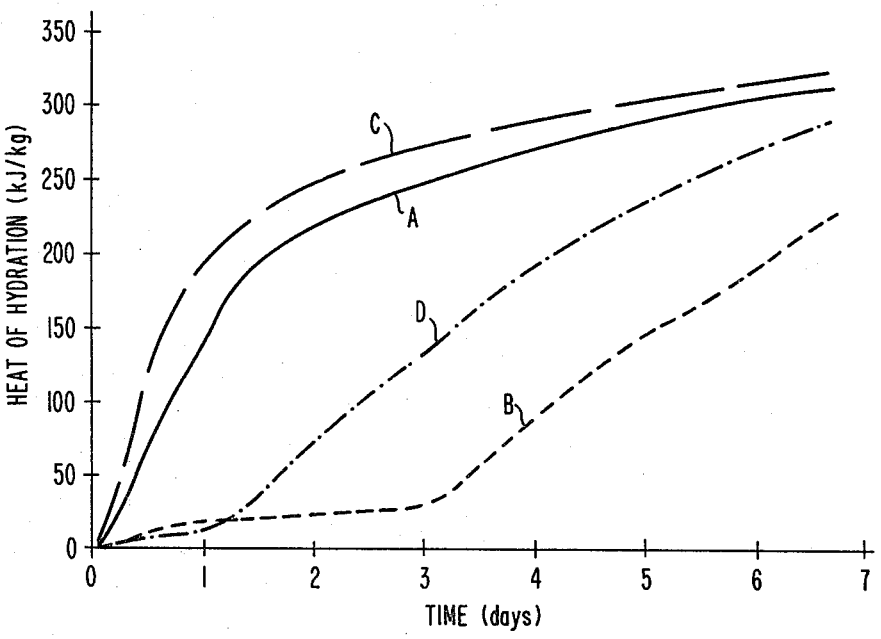
FIG. 2 shows curves illustrating the effect of shear on heat of hydration versus time for an ordinary Portland cement in (a) water and (b) saturated borax solution.

During the course of performing work in seeking resolution of the problem created by borates in cement mixes, it was unexpectedly found that by utilizing a high shear mixer and subjecting cement paste containing borax to a high degree of shear that the retarding action of the borates could be substantially offset. FIG. 2 clearly illustrates the effects of high shear on a cement mixture containing borax. These curves illustrate the effects of paddle and high shear mixing of ordinary Portland cement with a liquid/cement ratio of 0.5 at 20° C. Curves A and B show the results of paddle mixing of separate water/cement and saturated borax solution/cement mixes, and curves C and D show the results of high shear mixing of separate water/cement and saturated borax solution/cement mixes. As expected Curves A and B in FIG. 2 correspond in slope with curves A and B in FIG. 1 since customary mixing procedures are used in mixing the cement pastes. It also was found that paddle mixing, as distinguished from high shear mixing, of the saturated borax solution, did not offset bleeding or retardation of set unless very low solutions to cement ratios were used. When such low solution were used, the mix did not easily flow. This is necessary for good mixing.

As illustrated in curve D of FIG. 2, subjecting cement pastes containing borax to a high degree of shear helps offset the retarding action of the borates. It was found that calcium borate was formed from the borax and calcium ions were released from the cement but the shearing action appears to prevent the calcium borate from being retained on the hydrating surface. The colloidal sol created by this high shearing action and its subsequent gelling, creates, a paste with a high cohesion between cement particles. This together with a high water retentivity is ideal for the purpose of encapsulation without bleeding. Eventually, with prolonged action, reaction heat is generated with consequent stiffening in the mix, and too much resistance to flow can cause the mixer to cease operating.

Although different kinds of mixers which impart shear to a cement mix are available, one mixer particularly suited for imparting a high degree of shear to cement pastes is the Colcrete colloidal mixer manufactured by Colcrete Ltd., of Strood Kent, England. It is a high shear mixer and is particularly effective in thoroughly mixing the cement with a high shearing action to remove the borate coating from the calcium silicate hydrate particles. The essential part of the mixer is a unit containing an eight-inch diameter disc which rotates at about 2000 rpm. The disc is rotated in a housing by an appropriate power unit and the cement/waste mix is formed into a colloidal mixture or grout by passage at high speed through a narrow gap of ⅛ inch between the disc and housing walls. The disc carries projecting vanes on its periphery which pump or recirculate the waste/cement mixture through the gap at high speed to cause thorough mixing through the shearing action. Thus the mixture is subjected to shear, mixing and pumping by one unit. Further, the mixer has a small internal volume. In the event of mechanical failure or premature set-up of the cement, the radiation levels of waste products in the mix would be relatively low because of the small cement mass in the unit. Also, the low volume makes it possible to clean the mixer without generating large quantities of radioactive waste water.

Figure 3:
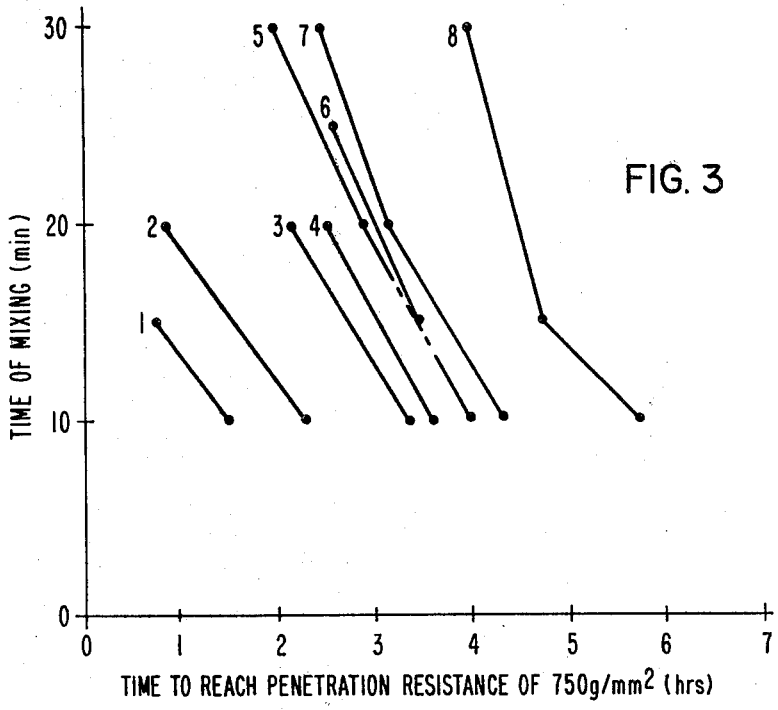
FIG. 3 shows curves illustrating the effects of mixing time, water/cement ratio and mixer speed on stiffening of cement pastes using a Colcrete mixer.

To provide a reference and to show the improvement in this invention over the prior art, FIG. 3 illustrates curves which shows the effects of the following mixing times, water/cement ratios and mixers speeds on stiffening of cement paste using a Colcrete mixer.

| Mix | Water/Cement Ratio | Mixer Speed |
|---|---|---|
| 1 | 0.4 | 2100 |
| 2 | 0.4 | 1980 |
| 3 | 0.45 | 2100 |
| 4 | 0.45 | 1980 |
| 5 | 0.4 | 1480 |
| 6 | 0.5 | 2100 |
| 7 | 0.5 | 1980 |

-continued

| Mix | Water/Cement Ratio | Mixer Speed |
|---|---|---|
| 8 | 0.45 | 1480 |

None of the mixes contain borax and all set within six hours. Mixes with a water/cement ratio below 0.5 stiffens rapidly in the mixer and for a water/cement ratio of 0.45, 15 minutes mixing is a safe limit relative to stiffening for a mixer speed of 2100 rpm. For a mix with a water/cement ratio of 0.40, the safe limit is 10 minutes at a mixer speed of 2100 rpm and at these parameters, the mix does not flow very readily. Of all mixes, only the mix with a water/cement ratio of 0.5 mixed for 10 minutes at a speed of 1980 rpm had bleed water remaining after 24 hours. With faster mixers there is no bleeding of the mixes with water/cement ratios less than 0.45 after 10 minutes mixing.

Figure 4:
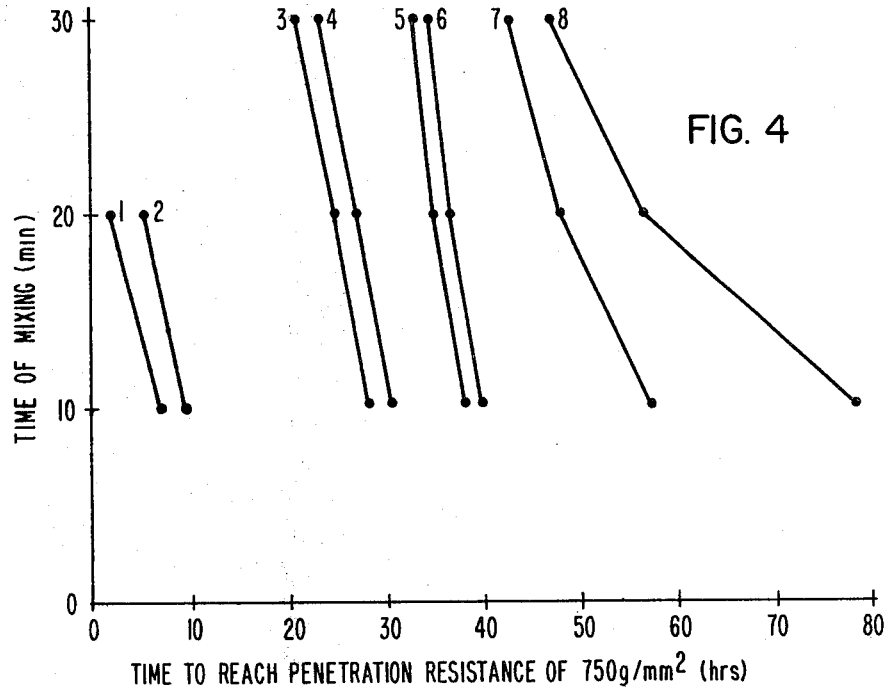
FIG. 4 shows curves illustrating the effect of mixing time, water/cement ratio and mixer speed on stiffening of cement pastes containing 18.5% borax in the absence of beads.

FIG. 4 shows the effect of mixing time, water cement ratio and mixer speed on stiffening of cement pastes containing 18.5% borax in the absence of beads or other filler.

| Mix | Water/Cement Ratio | Mixer Speed |
|---|---|---|
| 1 | 0.4 | 2100 |
| 2 | 0.4 | 1980 |
| 3 | 0.45 | 2100 |
| 4 | 0.45 | 1980 |
| 5 | 0.50 | 2100 |
| 6 | 0.50 | 1980 |
| 7 | 0.50 | 1480 |
| 8 | 0.55 | 1980 |

The persistence of bleed water in the foregoing mixes and how soon these mixes containing high concentrations of borax will set are important factors in determining quality of mix. The borax concentration of 18.5% to water used in the mixes was made by first adding water and borax in the desired ratio to the mixer and mixing the solution for two minutes. Subsequently, cement was added and time of mixing commenced. The curves show a cement paste can be produced from a mixture of water and 18.5% borax with twice its weight of cement, which will stiffen in 36 hours and not display bleed water. The mixer must have a speed more than 2000 rpm and the mixing must continue for 30 minutes. Lesser times or speed will not stop the persistence of bleed water.

With an 18.5% solution to cement ratio of 0.45 some bleeding occurs but this bleed solution is drawn back into the mix before setting takes place. If mixed for 10 minutes, such a mix will stiffen within 30 hours. Mixing for 30 minutes results in stiffening in less than 24 hours. It has been found that reducing the borax concentration from 18.5% to 2% speeds up the setting process. Ten minutes of mixing time with a solution to cement ratio of 0.45 causes set to take place under six hours, but the mixer can still operate for 20 minutes without flow ceasing. A comparison of the results of these mixes can be made with those mixes not containing borax as illustrated in FIG. 3.

If the solution to cement ratio is reduced to 0.4, the flow in the mixer begins to slow down after about 18 minutes and the speed of the mixer is an important factor in promoting stiffening.

As indicated above, the important concept in this invention is based on knowledge that borates normally will prevent bonding between cement particles but it was found that when cement was sheared at a particular rate, it elimated the adverse effects of borates and thus permitted bonding. In this way, radioactive borates can be incorporated in a cement mixture and still get the cement mixture to set.

The amount of shear imparted to the cement/waste mix per unit of time depends on the load volume (L) and flow rate through the gap in the Colcrete colloidal mixer. Since the flow rate depends upon the rate of rotation of the disc (R) and the flow characteristics of the mix, the total shear received by the mix (S) is:

$$S = Kf^{-}(R/L) \times \text{Time}.$$

The amount of shear affects the setting time of the mix by exposing more surface to the liquid phase. If the development of final set is considered, i.e. 750 g/mm$^2$ penetration, as an indicator for a constant amount of reaction, $f^{-}(R/L) \times T$ is constant.

The mixer which rotated at a constant speed of 1480 rpm was loaded with 67 Kg cement 33 Kg water and 6.2 Kg borax. After 10 minutes, 4.5 liters of paste were removed for testing and after another 10 minutes another 4.5 liters were removed for testing. This was repeated with a second mixer which rotated at a constant speed of 1980 rpm and a third mixer at 2100 rpm.

The samples were tested for penetration resistance after various period of time and plots were drawn of resistance versus time. From these plots the age of each sample when penetration resistance reached 750 g/mm$^2$ was found.

Figure 5:
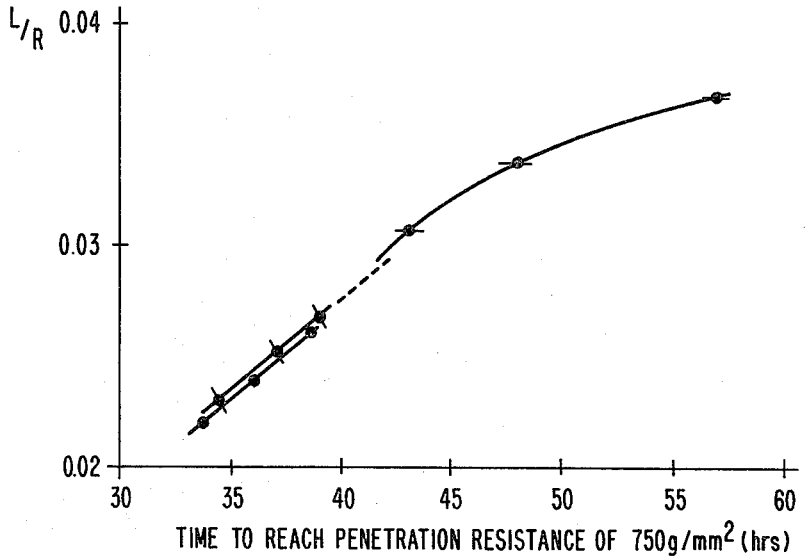
FIG. 5 shows curves illustrating the correlation of shear as defined by load volume/disc speed ratio with time to set of cement paste with a water/cement ratio of 0.5 and containing 18.5% borax solution.

FIG. 5 shows the correlation of shear is defined by load volume—disc speed ratio with time to set of current paste with a water/cement ratio of 0.5 and containing 18.5% borax solutions. Curve A represents disc rotation of 2100 rpm, Curve B represents disc rotation of 1980 rpm and Curve C 1480 rpm.

An important source of waste material in reactor systems is ion exchange resin beads conventionally used for stripping radioactive particles from liquid circulated in the secondary side of the system. The resin beads usually are cross linked polystyrene beads in the size range 0.35 mm to 1.2 mm. The beads become contaminated during the course of capturing and releasing radioactive particles and when the resin useful life ends, it is drained free of liquid and disposed of as radioactive waste.

In considering the encapsulation of these resin beads in cement, the bead concentrations must be considered on a volume basis because of the bead low density, but dosage of cement is usually considered on a weight basis. In the water cement mixes in the CGS system, weight and volume are interchangeable for water but the borax concentration in solutions will affect the density. Two ratios are therefore important:

$R_1$—The ratio of solution volume to cement weight.

$R_2$—The ratio of bead volume to solution volume.

If the slight volume change which occurs when borax dissolves in water is not considered, and assuming a cement density of 3140 Kg/m$^3$, a volume for the mix can be based on the volume of beads ($V_B$) which is equal to:

$$V_B(1 + 1/R_2 + \tfrac{1}{3}.14R_1R_2)$$

Since the volume is fixed by the mixer or drum, the bead content is maximized by a high value of $R_1$ $R_2$.

However increasing $R_1$ will increase the tendency to bleed and retard set and strength development, and increasing $R_2$ will decrease strength, increase permeability and increase total radioactivity. A compromise is therefore reached by choosing the values of $R_1=0.45$ and $R_2=1$.

The borax content depends on the concentration in the particular liquid used and upon $R_1$. High values of $R_1$ permit more liquid per drum but this is offset by the increased retardation as the borax/cement ratio rises.

Figure 6:
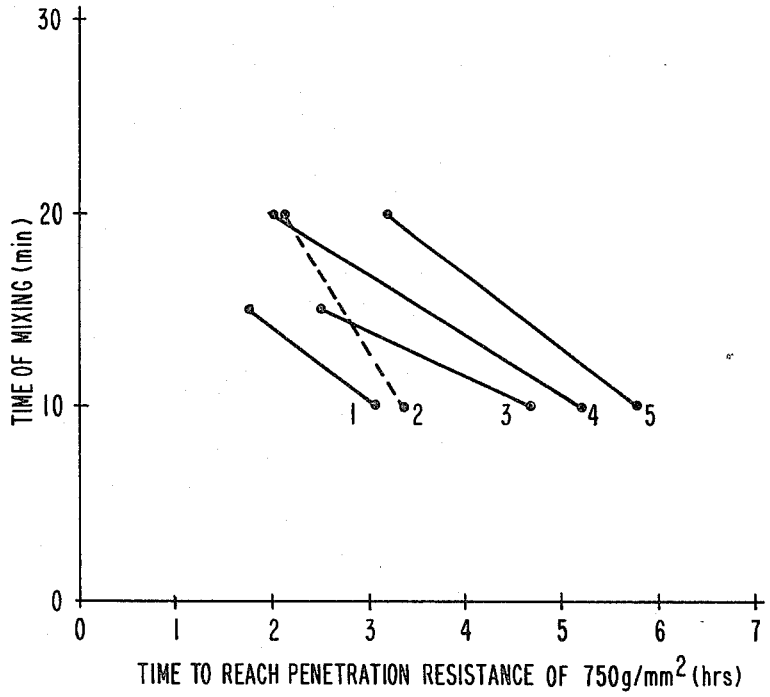
FIG. 6 shows curves illustrating the effects of mixing time and water/cement ratio on stiffening of cement pastes with and without borax and beads, using a Colcrete mixer.

FIG. 6 includes curves showing the effects of mixing time and water-cement ratios on stiffening of cement pastes with and without borax and beads, using a Colcrete high shear mixer. The data on which the curves are based include

| Mix | W/C Ratio | Borax % | Bead/Liquid Ratio | Mixer Speed rpm |
|---|---|---|---|---|
| 1 | 0.45 | — | 1:1 | 2100 |
| 2 | 0.45 | — | — | 2100 |
| 3 | 0.45 | 2 | 1:15 | 2100 |
| 4 | 0.45 | 2 | 1:1 | 2100 |
| 5 | 0.45 | 2 | — | 2100 |

These curves show the effect of mixing time and mix stiffening compared with that of a similar mix without beads. Since rapid stiffening in the mix will cause flow in the mixer to cease, control over mixing time is very important. The curves show that ten minutes mixing time is the maximum safe time for solutions of 2.0% borax before the reduction of flow in the mixer presents a problem.

Figure 7:
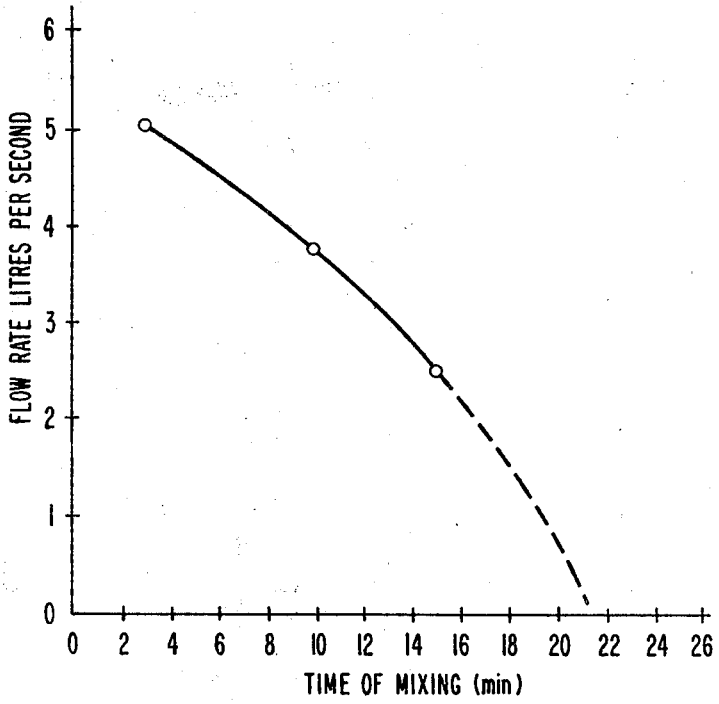
FIG. 7 shows a curve illustrating the change of flow rate of a mix with time of mixing.

The stiffening which occurs with prolonged shearing action on cement paste can reduce the flow of paste past the disc in the Colcrete mixer. When this occurs, the paste cavitates and flow will stop. The presence of beads in the mix increases the shearing action and the curve of FIG. 7 indicates the change of flow rate of a mix with time of mixing. It is based on the following mix:

| Cement | Water | Beads | Borax | Solution/ Cement |
|---|---|---|---|---|
| 83.25 Kg | 37.5 liters Bead Volume | 33.0 Kg | 825 g Vol. of Mix | 0.45 |
| | 41.25 | | 105.26 liters | |

The above quantity of mix filled a mixer about half full which was rotated at 2100 rpm. The curve of FIG. 12 shows that the flow rate decrease with time is not linear and that extrapolation to zero flow rate can be made. In this example flow ceased at about 22 minutes.

The setting behavior of the cement can be monitored with ultrasonic pulse velocity measurements of known design to ascertain that set has taken place in the mix. The results suggest that a pulse velocity above 1.70 Km per second will indicate that the mass is set. This pulse velocity is higher with beads in the mix.

Temperature peaks occur a short time after setting takes place and if monitored, temperature changes will indicate setting. On average, the time to set was 0.45× the time to temperature peak and this factor ranges from 0.28 to 0.63. The effect of temperature rise in a large mass will accelerate the setting of the material.

The retarding effect of borax on cement hydration can be countered by high shear mixing. It is possible to obtain a paste containing 18.5% borax to water with a water to cement ratio of 0.5 that will set within 36 hours without persistent bleed water. The stiffened mass continues to harden. The set is controlled by varying the concentration of borates in the cement mix which constitutes a retardant, or the number of shears applied to the cement mix. The presence of bulking additives, such as ion exchange beads, decreases the apparent effective number of shears required to be externally applied, since their presence in the mix increases the attrition on the cement particle surfaces. Similarly, by increasing the concentration of retardant present in the mix, it becomes necessary to increase the number of shears applied in order to produce the thixopaste.

As disclosed above, colloidal or high shear mixers are required to produce thixopaste when mixing in large scale equipment. For example, when using a batch type Colcrete colloidal cement mixer, mixing times of 15±three minutes are required to produce the thixopaste from mixtures contained within the range defined above. By changing the efficiency of shearing and suitable premixing of the components of the paste, the procedure may be converted to an in-line continuous flow process.

It will be apparent that many modifications and variations are possible in light of the above teachings. It therefore is to be understood that within the scope of the appended claims, the invention may be practiced other than as specifically described.

I claim:

1. A method of encapsulating radioactive waste comprising the steps of:

drawing a predetermined amount of radioactive liquid waste having a cement setting retardant therein from a source, said retardant constituting a component which variably retards set and strength development in a cement mix;

mixing said liquid waste in a high shear mixer to provide a homogeneously mixed, predetermined volume of liquid;

introducing a corresponding volume of cement into the predetermined volume of liquid to provide a cement paste;

subjecting the cement paste to high shear mixing in said mixer for a time sufficient to remove the retardant from the cement hydrating surface and until the retarding reactions have been overcome to thusly produce a thixotropic rapid setting cement.

2. The method according to claim 1 wherein the retardant constitutes borates in the liquid.

3. The method according to claim 2 including the step of charging the mixer with liquid and cement in the ratio between 0.40 and 0.55.

4. The method according to claim 3 including the step of increasing the number of shears applied to the mixture as the ratio of liquid to cement increases from 0.40 to 0.55 in mixture.

5. The method according to claim 2 including the step of mixing the cement paste for at least one-half hour to assure achieving thixotrophy and homogeneity in the mix.

6. The method according to claim 3 including the step of mixing the cement paste in a Colloidal mixer for 15±3 minutes to produce a thixopaste.

7. The method according to claim 3 including the step of mixing the cement paste in a colloidal batch mixer for about ten to thirty minutes to provide a bleedfree thixopaste.

8. The method according to claim 2 including the step of adding a bulk additive to the cement paste to decrease the number of shears to effect an increase in the attrition on cement particle surfaces and thereby accelerate the stiffening of the cement paste.

9. The method according to claim 8 including the step of adding a bulk additive in the form of ion exchange beads of the type used in nuclear reactor secondary systems.

10. The method according to claim 2 including the step of adding non-dissolvable, solid radioactive waste material to the cement mix.

* * * * *